US008083371B2

(12) United States Patent
Lin et al.

(10) Patent No.: US 8,083,371 B2
(45) Date of Patent: Dec. 27, 2011

(54) ILLUMINATION DEVICE

(75) Inventors: Chang-Yao Lin, Jhongli (TW); Jyh-Lih Wang, Jhongli (TW)

(73) Assignee: Trend Lighting Corp., Jhongli (TW)

( * ) Notice: Subject to any disclaimer, the term of this patent is extended or adjusted under 35 U.S.C. 154(b) by 244 days.

(21) Appl. No.: 12/641,816

(22) Filed: Dec. 18, 2009

(65) Prior Publication Data

US 2011/0149566 A1 Jun. 23, 2011

(51) Int. Cl.
*F21V 7/04* (2006.01)

(52) U.S. Cl. ..... 362/241; 362/240; 362/247; 362/301; 362/431

(58) Field of Classification Search ..... 362/249.02, 362/249.06, 431, 145, 153.1, 237, 240, 241, 362/243, 247, 297, 299, 301, 346
See application file for complete search history.

(56) References Cited

U.S. PATENT DOCUMENTS

| | | | | |
|---|---|---|---|---|
| 7,758,211 | B2 * | 7/2010 | Zheng et al. | 362/249.02 |
| 7,758,212 | B2 * | 7/2010 | Jan et al. | 362/249.02 |
| 7,828,456 | B2 * | 11/2010 | Boyer et al. | 362/153.1 |
| 8,002,428 | B2 * | 8/2011 | Boyer et al. | 362/153.1 |
| 2008/0219000 | A1 * | 9/2008 | Fan | 362/241 |

* cited by examiner

*Primary Examiner* — Thomas Sember
(74) *Attorney, Agent, or Firm* — Jackson IPG PLLC; Demian K. Jackson

(57) ABSTRACT

An illumination device includes a plurality of housings installed on a lamp holder, and each housing being arranged at the bottom of the lamp holder and tilted in a specific direction towards an exit aperture and having a light emitting diode device installed on each housing and opposite to two sidewalls on both sides of the inclined direction, and a reflection cover installed between adjacent housings, and each reflection cover having a plurality of first reflection surfaces and second reflection surfaces extended into each housing and towards the exterior of the housing. With the effect of the first and second reflection surfaces, the light source can be projected towards the exterior of the lamp holder effectively to increases the overall light projection range of the illumination device.

7 Claims, 9 Drawing Sheets

ILLUMINATION DEVICE

BACKGROUND OF THE INVENTION (a) Field of the Invention

The present invention relates to an illumination device, and more particularly to an illumination device using a light emitting diode as a light source and improving the illumination angle of the light source.

(b) Description of the Related Art

As the power saving issue becomes increasingly popular and governments of different countries prohibit the use of fluorescent bulbs. Light emitting diode (LED) has the advantages of high efficiency, power saving, and dimmerability, LED lamps become a trend in the illumination market, and used extensively in many fields such as road lamps, automobile lamps, outdoor illuminations and mood lighting.

However, the light emitting diode also has disadvantages, such as a small light emitting angle of tens of several degrees only. In other words, the light emitting diode has a high directivity, which is a negative number with respect to the wide-angle requirement of the illuminator with an uniform illumination angle. Therefore, it is a feasible technical solution to use light emitting diode as a light source by maximizing its advantages and minimizing its disadvantages.

As disclosed in R.O.C. Pat. No. M343772, a wide-angle illumination is provided for overcoming the drawback of the small illumination angle of the light emitting diode and providing a light emitting diode illuminator having the advantages of maximizing the life expectancy and reducing the power consumption of the light emitting diode. In FIG. 1, the light emitting diode illuminator 10 comprises a plurality of lamp housings 111 disposed on a lamp holder 11, an illumination end formed as an open end at the bottom of each housing, and at least two opposite hollow sidewalls disposed on the housing 111.

In addition, a light source module 12 for producing a light source includes a plurality of light emitting diodes 122 installed on a circuit board 121 and installed onto the lamp holder 11 with a corresponding outward inclination, and the light emitting diodes 122 on the circuit board 121 are exposed from opposite hollow sidewalls in each housing 111, and opposite to the illumination end of the housing 111 by an inclination. With the foregoing structure, the light emitting diodes 122 of each housing 111 installed in the lamp holder 11 provide illumination with a corresponding opposite outward angle and extend the illumination angle of an illumination end of each housing to increase the overall illumination angle of an illuminator.

In FIG. 2, the aforementioned conventional light emitting diode illuminator 10 is generally used for outdoor road illumination, but the illumination end of each housing 111 of the conventional light emitting diode illuminator 10 is aligned precisely with the bottom of the lamp holder 11, and thus the light projection range of the illuminator is limited to an area (as shown in FIG. 2) precisely opposite to the bottom of the lamp holder 11 only. When such light emitting diode illuminator is used as a road illuminator, it is necessary to install the LED illuminator with an inclination, so that the light source can project light towards the road, and such way of installing light emitting diode illuminators is applicable for roads in Taiwan, but not suitable for other foreign countries, since those installations are generally horizontal installations. As a result, the actual light projection on the road is very limited, and the conventional LED illuminator requires further improvements.

SUMMARY OF THE INVENTION

Therefore, it is a primary objective of the present invention to overcome the aforementioned shortcoming and deficiency of the prior art by providing a light emitting diode illumination device capable of extending the range of light projection.

To achieve the aforementioned objective, the illumination device of the present invention comprises: a plurality of housings installed on a lamp holder, and each housing being arranged at the bottom of the lamp holder and tilted in a specific direction from an exit aperture, and each housing having a light emitting diode device installed thereon and opposite to the inclined direction of the two sidewalls; and a reflection cover installed between adjacent housings, and each reflection cover having a plurality of first reflection surfaces horizontally extended between two sidewalls of each housing and towards the exterior of the housing and a plurality of second reflection surfaces extended vertically between two sidewalls of each housing and towards the bottom of the housing.

Under the effect of the first reflection surface and the second reflection, the light source produced by the light emitting diode device of each housing can project light towards the outside of the lamp holder effectively to extend the overall light projection range of the illumination device.

Another objective of the present invention is to provide an illumination device applicable for outdoor road illumination, and the invention not only improves the road illumination effect significantly, but also retracts the installation position of the illumination device towards both sides of the road to improve the safety of pedestrians.

DETAILED DESCRIPTION OF THE PREFERRED EMBODIMENTS

Figure 1:
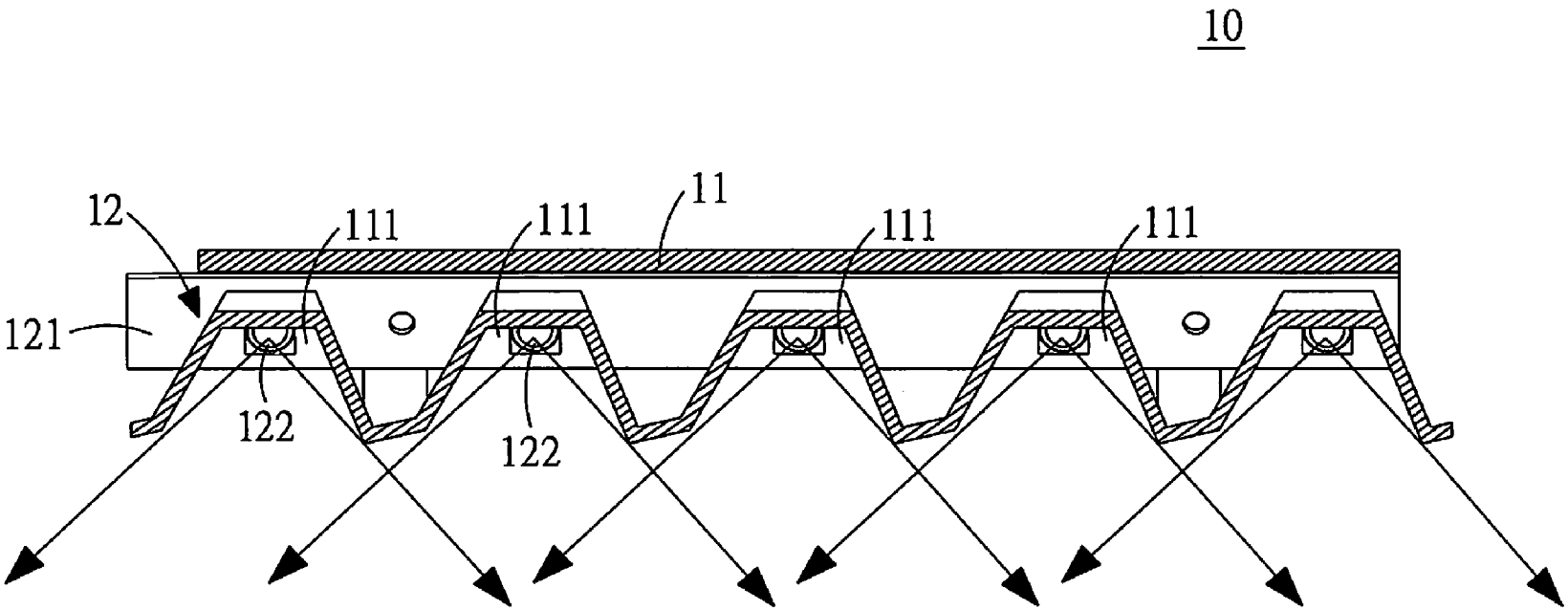
FIG.1 PRIOR ART
FIG. 1 is a cross-sectional view of a structure of a conventional light emitting diode illuminator.
Figure 2:
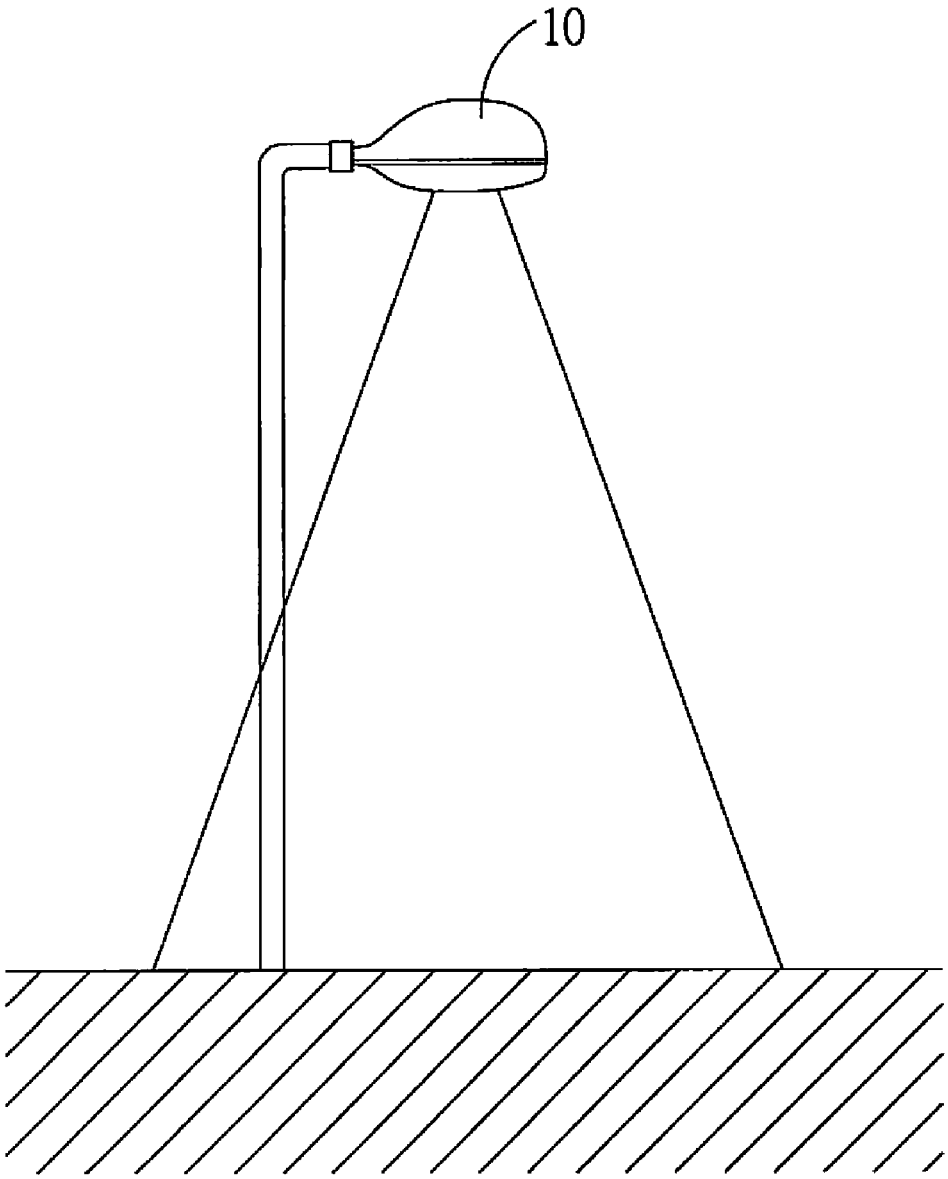
FIG.2 PRIOR ART
FIG. 2 is a schematic view of using a conventional light emitting diode illuminator.
Figure 3:
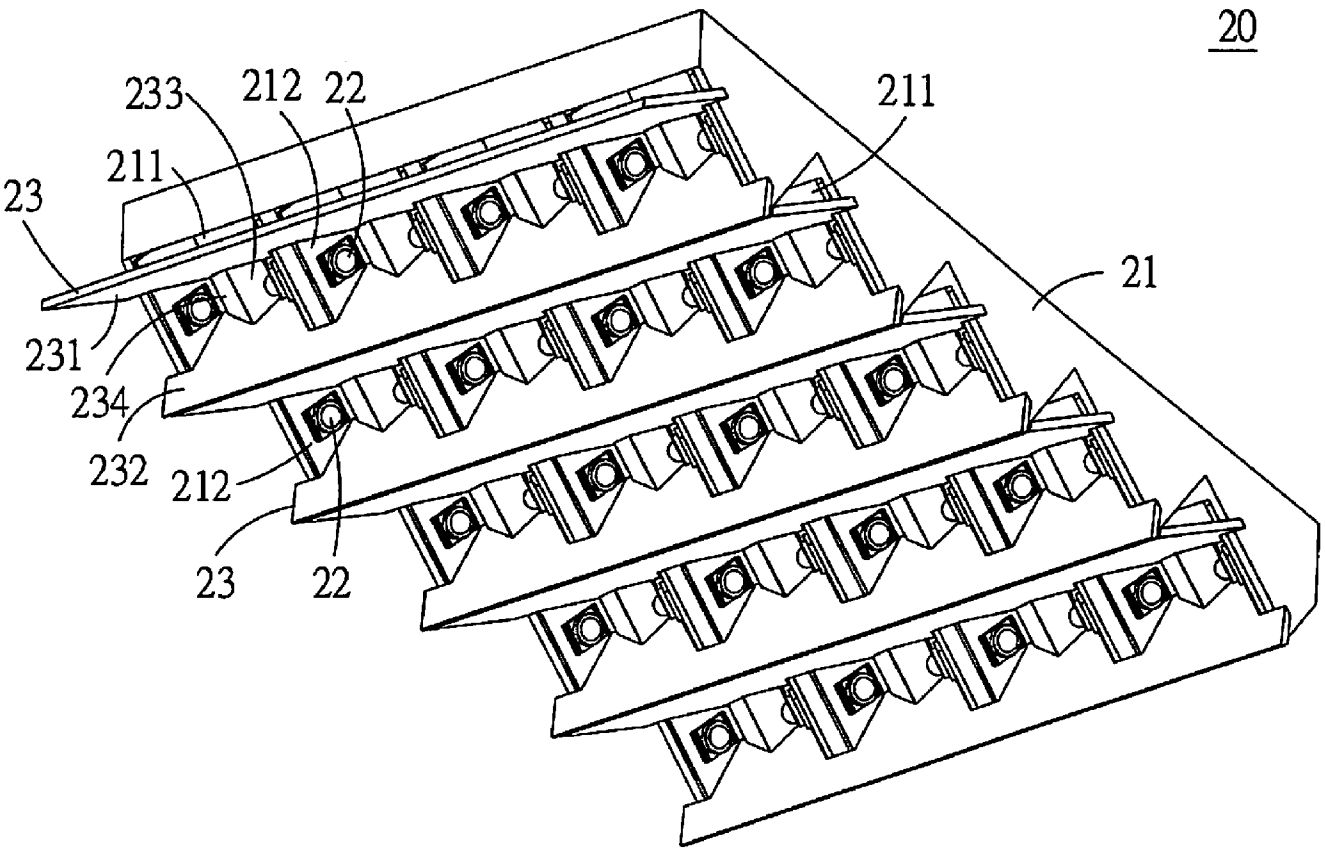
FIG. 3 is a perspective view of a structure of an illumination device in accordance with the present invention.
Figure 4:
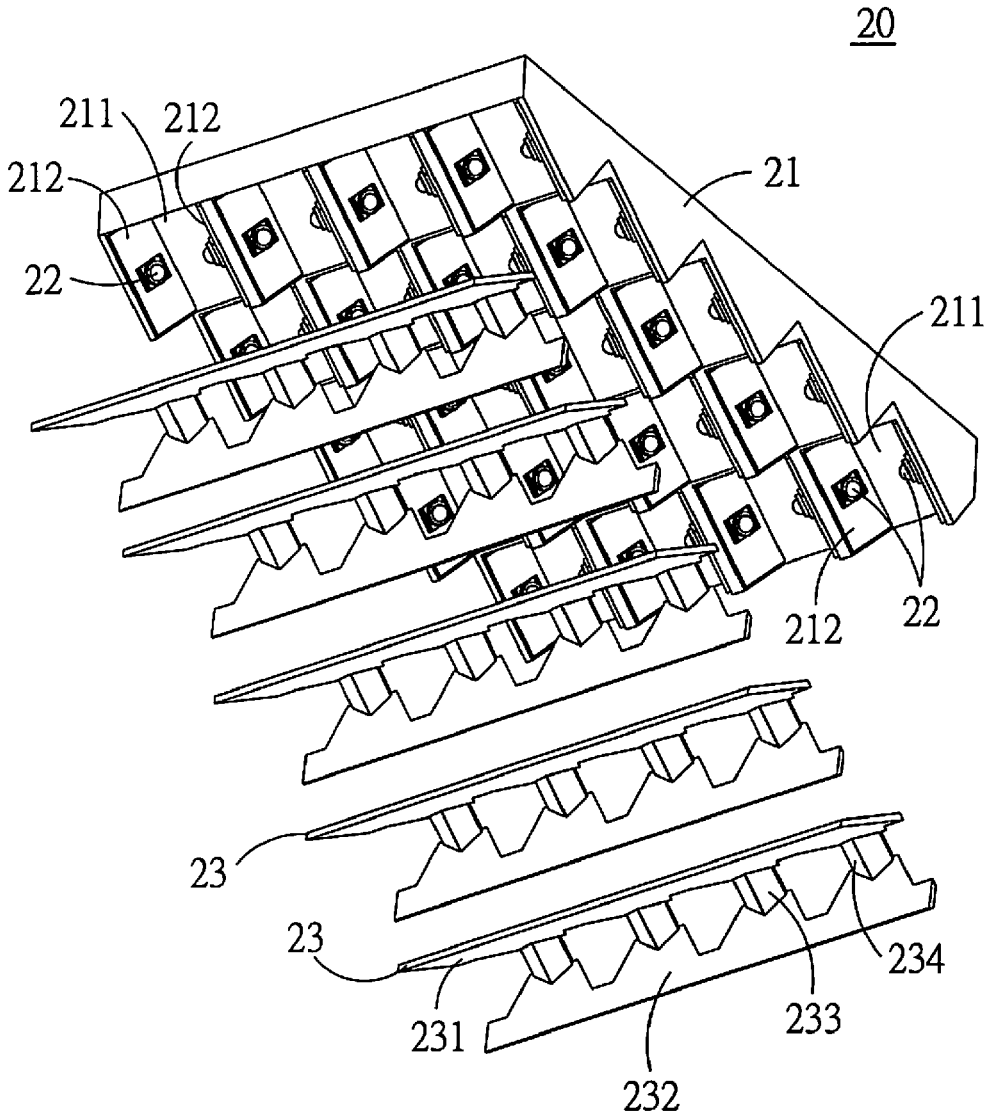
FIG. 4 is an exploded view of a structure of an illumination device in accordance with the present invention.

The technical characteristics of the present invention will become apparent with the detailed description of the preferred embodiments and the illustration of the related drawings as follows.

With reference to FIGS. 3 to 6 for an illumination device 20 of the present invention, the illumination device 20 comprises a lamp holder 21, a plurality of light emitting diode elements 22, and a plurality of reflection covers 23.

In a preferred embodiment as shown in the figures, the lamp holder 21 includes a plurality of housings 211, each housing 211 being arranged at the bottom of the lamp holder 21 and tilted with a specific direction towards an exit aperture, and an angle θ is defined between each housing 211 and the bottom of the lamp holder 21, and the angle θ is smaller than 90 degrees, and the lamp holder 21 has a sidewall 212 formed separately on both sides of the inclined direction with respect to each housing 211 for carrying a light emitting diode device 22, and the two sidewalls 212 are tilted with an inclination and disposed opposite to the exit aperture of each housing 211, such that the two sidewalls 212 is tilted towards an internal side of the housing 211. In the preferred embodiment as shown in the figures, the inclined direction of each housing 21 is not coaxial with the inclined direction of the two sidewalls. Each light emitting diode device 22 is installed separately on the sidewalls 212 on both sides of each housing 211. Of course, a reflection layer can be coated onto the sidewall 212 to improve the reflection effect of the light source.

Each reflection cover 23 is installed between adjacent housings 211 of the lamp holder 21, and each reflection cover 23 has the same inclined direction of each housing 21. In the preferred embodiment as shown in the figure, each reflection cover 23 includes a plurality of first reflection surfaces 231 extended between the two sidewalls 212 of each housing 211 and extended horizontally towards the exterior of the housing 211, and a plurality of second reflection surfaces 232 extended between the two sidewalls 212 of each housing 211 and extended vertically towards the bottom of the housing 211, and the first reflection surface 231 has a length greater than the length of the second reflection surface 232. In addition, each reflection cover 23 has a light collection section coupled between first reflection surface 231 and the second reflection surface 232 that are extended into each housing 211, and each light collection section has a third reflection surface 233 and a fourth reflection surface 234 tilted towards the two sidewalls 212 respectively.

Figure 5:
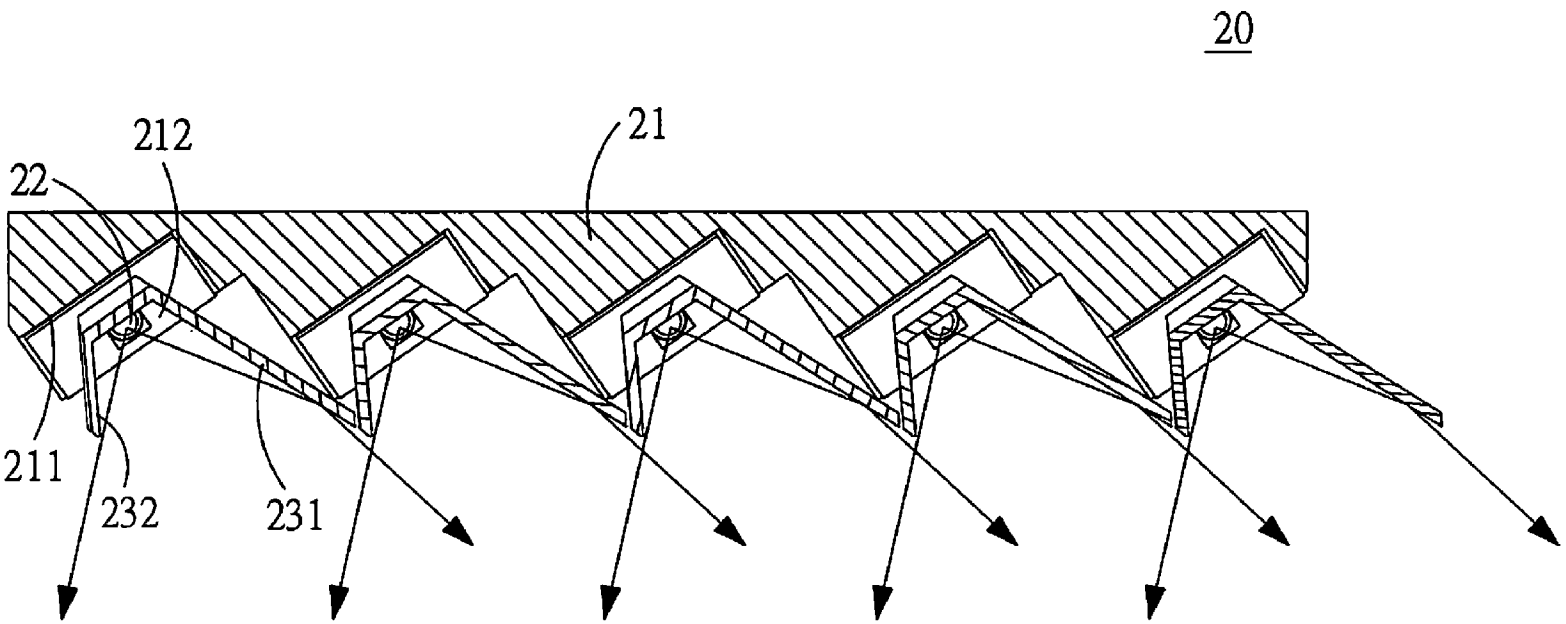
FIG. 5 is a cross-sectional view of a structure of an illumination device in accordance with the present invention.
Figure 7:
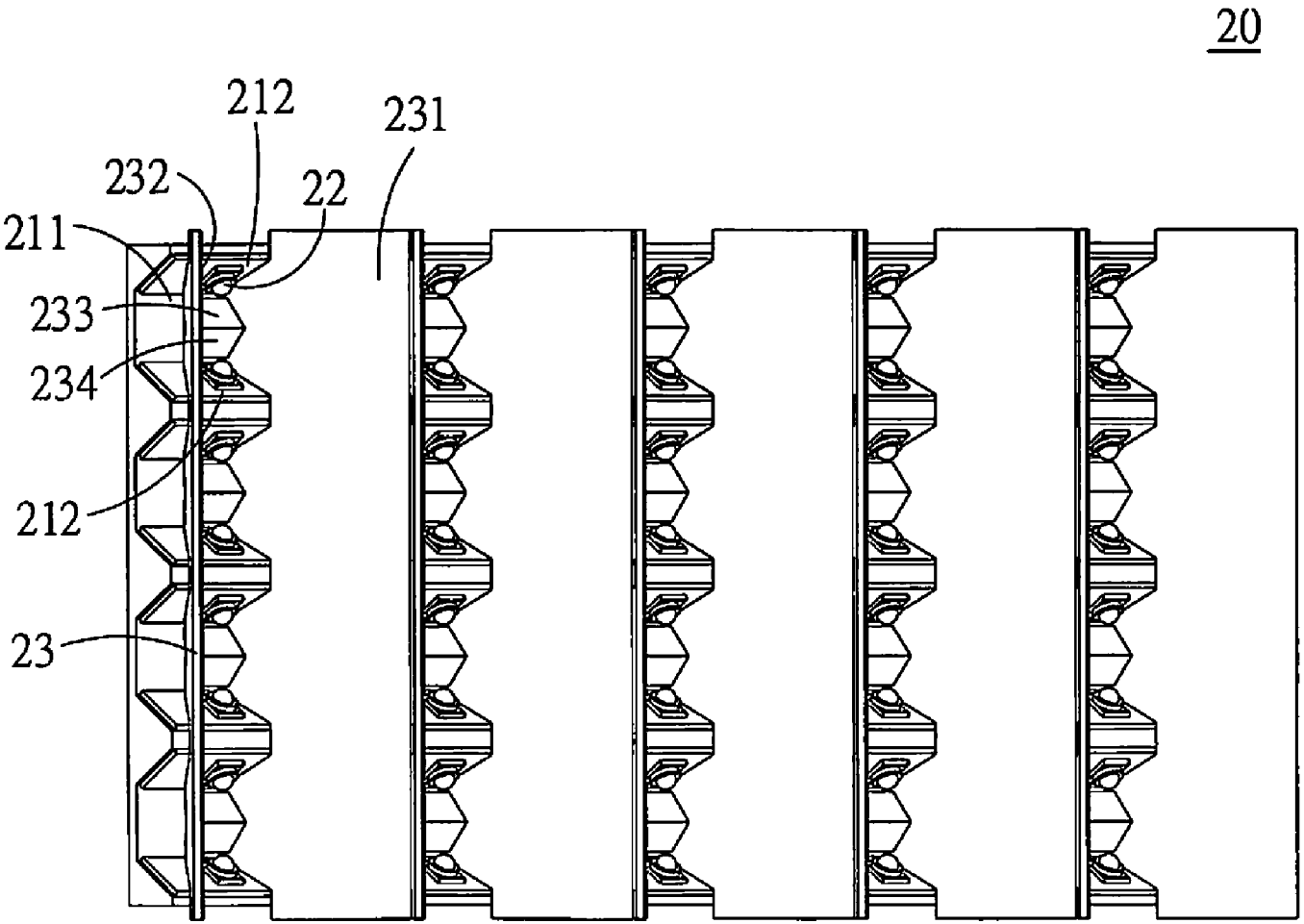
FIG. 7 is a planar structural view of the bottom of an illumination device in accordance with the present invention.

In FIGS. 5 and 7, when the illumination device of the present invention is operated under the effect of the first reflection surface 231 and the second reflection surface 232, the light source produced by the light emitting diode device 22 of each housing 211 can project light towards the exterior of the lamp holder 21 effectively to extend the light projection range of the illumination device 20. With the reflection effect of the third reflection surface 233 and the fourth reflection surface 234 in the light collection section, the light source deep inside each housing 211 can be projected towards the exit aperture to improve the illumination brightness of the illumination device.

Figure 6:
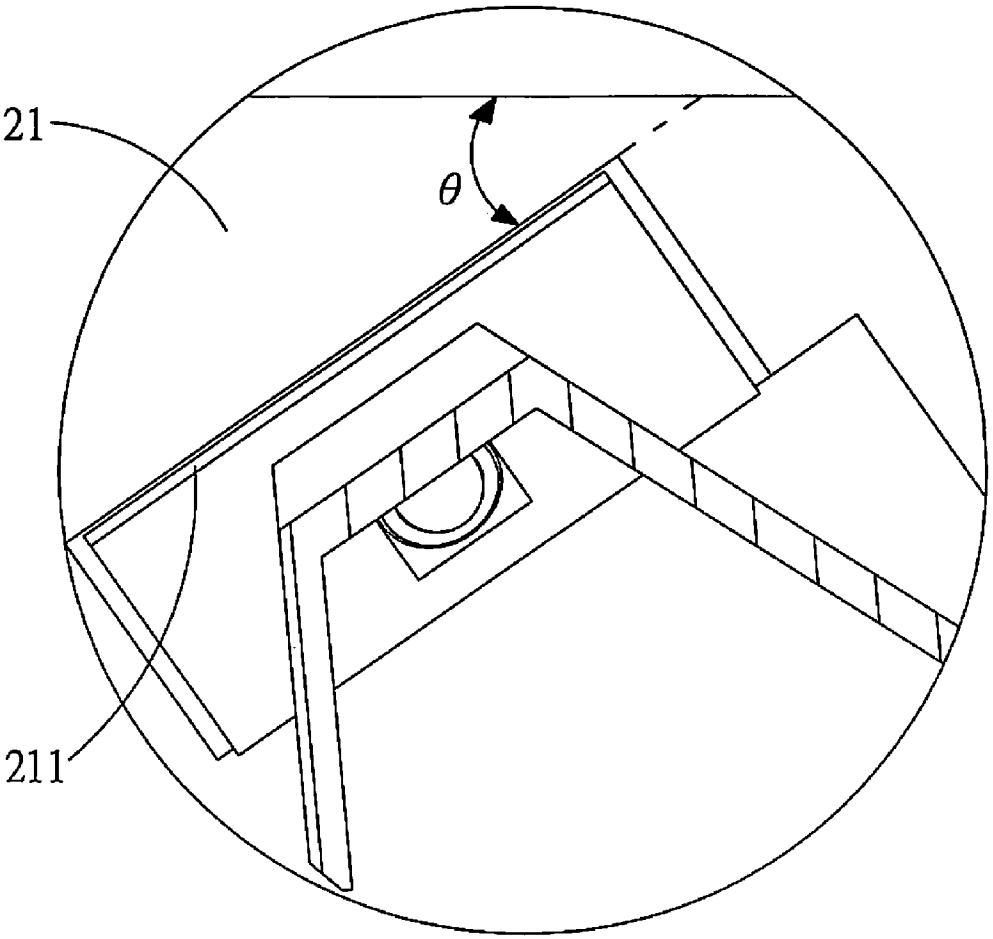
FIG. 6 is an exploded view of a partial structure of an illumination device in accordance with the present invention.
Figure 8:
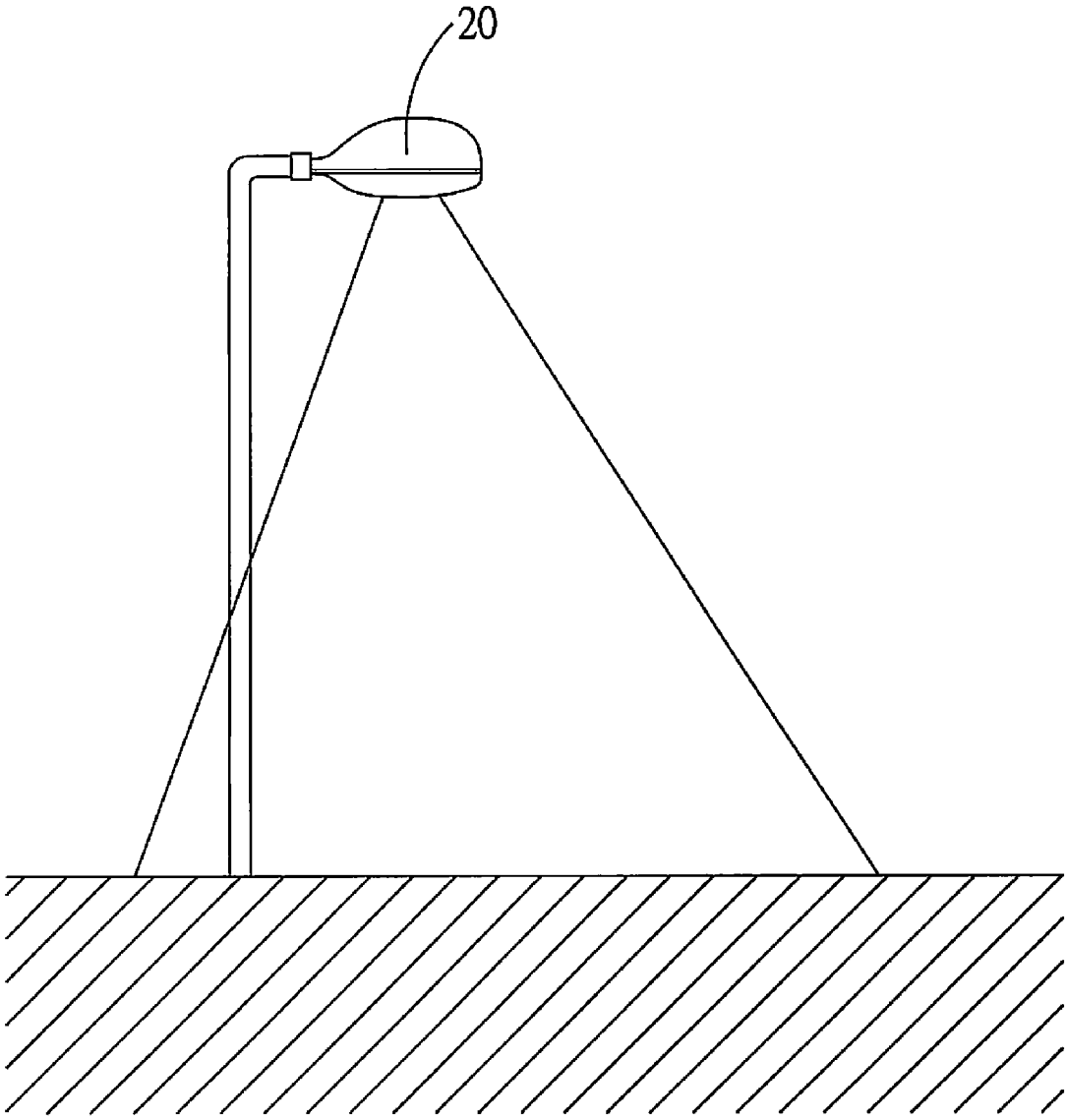
FIG. 8 is a schematic view of using an illumination device in accordance with the present invention.
Figure 9:
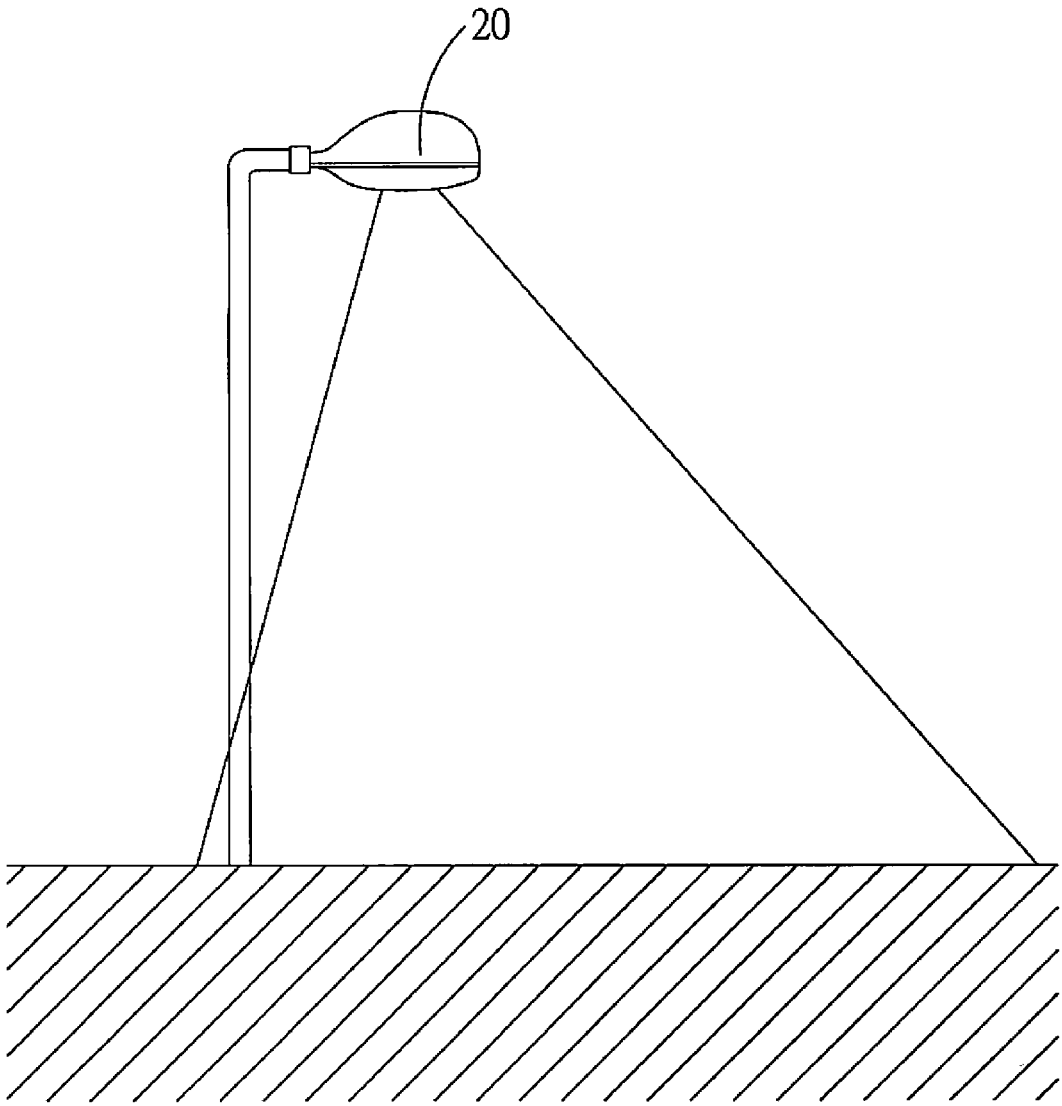
FIG. 9 is another schematic view of using an illumination device in accordance with the present invention.

The illumination device of the present invention maximizes the power saving effect and life expectancy of the light emitting diode and also overcomes the limitation of a small light emitting angle of the light emitting diode to provide a wide-angle illumination function. Such illumination device is particularly suitable for outdoor road illumination as shown in FIG. 8. The illumination device can improve the light projection range on the road, and thus improving the road illumination effect effectively, expanding the light projection range of the illumination device 20, retracting the installation position of the illumination device 20 to both sides of the road to improve the safety of pedestrians. Of course, the inclination of each housing 211 can be controlled as shown in FIG. 6. If the included angle θ is too large, then the light projection range of the illumination device can be extended to a larger road surface of the road as shown in FIG. 9.

In summation of the description above, the present invention provides a feasible crystalline silicon formation method and its formation apparatus and complies with the patent application requirements, and thus the invention is duly filed for patent application.

While the invention has been described by device of specific embodiments, numerous modifications and variations could be made thereto by those generally skilled in the art without departing from the scope and spirit of the invention set forth in the claims.

We claim:

1. An illumination device, comprising:

a lamp holder, including a plurality of housings, and each housing being arranged at a bottom of the lamp holder and tilted in a specific inclined direction towards an exit aperture, and a sidewall disposed on both sides of an inclined direction with respect to each housing of the lamp holder for carrying a light emitting diode device, and the two sidewalls being titled with respect to the inclined direction of the housing and disposed opposite to the exit aperture of each housing;

a plurality of light emitting diode elements, installed on the sidewalls on both sides of each housing respectively;

a plurality of reflection covers, each being installed between adjacent housings of the lamp holder, and having a plurality of first reflection surfaces extended between the two sidewalls of each housing and extended horizontally towards an exterior of the housing and a plurality of second reflection surfaces extended between the two sidewalls of each housing and extended vertically towards a bottom of the housing.

2. The illumination device of claim 1, wherein the inclined direction of each housing is a direction axially different from the inclined directions of the two sidewalls.

3. The illumination device of claim 1, wherein the two sidewalls are inclined towards internal sides of the housing, and the inclined direction of each housing is a direction axially different from the inclined directions of the two sidewalls.

4. The illumination device of claim 1, wherein each housing forms an included angle θ with the bottom of the lamp holder, and the included angle θ is smaller than 90 degrees.

5. The illumination device of claim 1, wherein each reflection cover has a light collection section extended into each housing and coupled between the first reflection surface and the second reflection surface correspondingly.

6. The illumination device of claim 1, wherein each reflection cover has a light collection section extended into each housing and coupled between the first reflection surface and the second reflection surface correspondingly, and each light collection section has a third reflection surface and a fourth reflection surface extended towards the two sidewalls slantingly and respectively.

7. The illumination device of claim 6, wherein the first reflection surface has a length greater than a length of the second reflection surface.

* * * * *